US005798505A

United States Patent [19]

Lee

[11] Patent Number: 5,798,505

[45] Date of Patent: Aug. 25, 1998

[54] MICROWAVE OVEN WITH UPWARDLY DIRECTED AIR DISCHARGE DUCT

[75] Inventor: Jeong Hee Lee, Euiwang, Rep. of Korea

[73] Assignee: Samsung Electronics Co., Ltd., Suwon, Rep. of Korea

[21] Appl. No.: 721,541

[22] Filed: Sep. 26, 1996

[30] Foreign Application Priority Data

Oct. 7, 1995 [KR] Rep. of Korea ..... 1995-28066

[51] Int. Cl.[6] ..... H05B 6/80; F24C 1/02

[52] U.S. Cl. ..... 219/681; 219/757; 219/400; 126/21 A

[58] Field of Search ..... 219/681, 757, 219/400; 126/21 A, 21 R

[56] References Cited

U.S. PATENT DOCUMENTS

| | | | |
|---|---|---|---|
| 4,332,992 | 6/1982 | Larsen et al. | 219/681 |
| 4,392,038 | 7/1983 | Day et al. | 219/681 |
| 4,940,869 | 7/1990 | Scholtes et al. | 219/681 |
| 5,477,036 | 12/1995 | Jun et al. | 219/757 |

FOREIGN PATENT DOCUMENTS

| | | | |
|---|---|---|---|
| 61-165525 | 7/1986 | Japan | 219/400 |
| 5-106848 | 4/1993 | Japan | 219/757 |
| 2 105 459 | 3/1983 | United Kingdom | 219/400 |

*Primary Examiner*—Philip H. Leung

*Attorney, Agent, or Firm*—Burns, Doane, Swecker & Mathis, L.L.P.

[57] ABSTRACT

A microwave oven has a cooking chamber in which an electric heater is provided to perform convection cooking as an alternative to high frequency cooking. Heat from the heater is circulated within the cooking chamber by a heat-circulation fan situated behind an apertured back wall of the cooking chamber. A cooking chamber disposed behind the heater houses a motor for driving the heat circulation fan and also for driving a cooling fan disposed in the cooling chamber. The cooling fan draws in cooling air through cool air apertures formed in the rear of the oven. Hot exhaust air from the cooking chamber is discharged through exhaust holes formed in the rear of the oven, next to the cool air apertures. In order to minimize the travel of hot exhaust air from the exhaust holes to the cool air apertures a guide duct mounted on the rear of the oven directs the exhaust air from the exhaust holes upwardly to a discharge outlet at the top of the duct.

2 Claims, 5 Drawing Sheets

MICROWAVE OVEN WITH UPWARDLY DIRECTED AIR DISCHARGE DUCT

BACKGROUND OF THE INVENTION

The present invention relates to a convection microwave oven, and more particularly, to an air exhaust passage thereof.

Generally, the microwave oven is a cooking appliance which cooks foods by a frictional heat generated by causing the molecules of the foods being cooked to move at high speeds by using high frequency energy. Recently developed is a convection microwave oven having the cooking function using a forced convection of hot air created by an electric heater and a blower fan in addition to a basic cooking function by high frequency energy.

In such a convection microwave oven, foods such as meat and fish are cooked evenly from surface to interior by the high frequency energy and at the same time, the surface of the foods is browned to a crisp by the hot air, so that the taste and flavor of foods are enhanced. Of course, the convection microwave oven can only use either the high frequency energy or the heater at one time.

FIG. 5 illustrates the air circulation in a prior art convection microwave oven. As shown in FIG. 5, there is a cooking chamber 2 in an inner space of a case 1, wherein an electric component compartment 4 and an exhaust passage 2*f* are formed at respective opposite sides of the cooking chamber 2. In the electric component compartment 4, electric components such as a magnetron 3*a* for radiating high frequencies, a high voltage transformer 3*b*, and a high capacitor 3*c* are installed. On a rear wall of the electric component compartment 4, a cooling fan 3*d* for cooling the above electric components which maintain a high temperature state of operation is also mounted. To supply the cooling fan 3*d* with the outside air, a plurality of intake holes 1*b* are formed on a rear plate 1*a* of the case 1. A plurality of first air vents 2*c* are formed on a right side plate 2*a* of the cooking chamber 2 so that air blown by the cooling fan 3*d* can be transferred from the electric component compartment 4 to the cooking chamber 2.

In the rear of the cooking chamber 2, a hot air blowing chamber 5*a* is formed. In the hot air blowing chamber 5*a*, an electric heater 6 and a blower fan 7 for forcing heat generated by the electric heater 6 to the cooking chamber 2 are installed. In the rear of the hot air blowing chamber 5*a*, there is a cooling chamber 5*b* separated by a duct 8. In the cooling chamber 5*b*, a driving motor 7*a* for driving the blower fan 7 and a cooling fan 9 for cooling the driving motor 7*a*. The blower fan 7 and the cooling fan 9 are rotated by a common driving shaft coupled to the driving motor 7*a*.

The duct 8 is installed between the blower fan 7 and the cooling fan 9 so as to prevent the heat radiated by the electric heater 6 and the blower fan 7 from being discharged to the rear of the hot air blowing chamber 5*a*, i.e., the cooling chamber 5*b*. According to the above construction, the blower fan 7 circulates only the air in the cooking chamber 2, and the cooling fan 9 circulates only the outside air through air vents 1*d* formed on the rear plate 1*a* of the case 1. The exhaust passage 2*f* arranged in the left side of the cooking chamber 2 is provided with a plurality of second air vents 2*d* and exhaust holes 1*c*. The second air vents 2*d* are formed on the left side plate 2*b* of the cooking chamber 2, and the exhaust holes 1*c* are formed on the rear plate 1*a* of the case 1.

In the prior art convection microwave oven, firstly when the user pushes the start button, power is supplied to the electric components such as the magnetron 3*a*, the high voltage transformer 3*b*, and the high voltage capacitor 3*c*, so that the high frequency generated by the magnetron 3*a* enters the cooking chamber 2. Accordingly, the food in the cooking chamber 2 is cooked. Simultaneously, the cooling fan 3*d* located on the back side wall of the electric component compartment 4 is operated to take the outside air into inside through the intake holes 1*b*. After this air cools the electric components, it is taken into the cooking chamber 2 through the first air vents 2*c*. The air coming into the cooking chamber 2 is discharged through the second air vents 2*d* into the exhaust passage 2*f* along with humidity generated during the cooking of food and then exhausted through the exhaust holes 1*c* to the outside of the microwave oven.

However, since the prior art convection microwave oven has such a structure that the exhaust holes 1*c* are arranged adjacent to the air vents 1*d* for the cooling chamber 5*b* as shown in FIG. 5, hot air exhausted through the exhaust holes 1*c* via the electric component compartment 4 and the cooking chamber 2 enters again the cooling chamber 5*b* through the air vents 1*d*. As a result, efficiency of the driving motor 7*a* installed in the cooling chamber 5*b* is reduced.

Further, in case of cooking the foods by both the convection cooking mode using the electric heater 6 and the high frequency cooking mode using the magnetron 3*a*, convection heat generated by the electric heater 6 is forced into the cooking chamber 2 by means of the blower fan 7. A portion of that hot air, is exhausted through the exhaust passage 2*f* along with the air entered through the electric component compartment 4. Therefore, since the hot air heated by the electric heater 6 may re-enter the cooling chamber 5*b* through the air vents 1*d*, the efficiency of the driving motor 7*a* is reduced, and it may have an effect on the coils of the driving motor 7*a* to cause a breakdown.

SUMMARY OF THE INVENTION

It is an object of the present invention to provide a convection microwave oven capable of preventing an electric motor from being damaged by inflow of hot air by directing the hot air via a cooking chamber above the microwave oven.

In order to achieve that objective, this invention provides a convection microwave oven comprising an inner case, an outer case forming a cooking chamber together with the inner case, an electric component compartment and exhaust passage arranged on opposite sides of the cooking chamber having an electric heater therein, a hot air blowing chamber having a blower fan therein, a cooling chamber which is partitioned with the hot air blowing chamber by a duct and is provided with an electric motor and a cooling fan, and guiding means for directing in an upward direction hot air exhausted from a plurality of exhaust holes formed in the outlet of an exhaust passage.

The guiding means comprises a plurality of slits formed on both sides of the exhaust holes arranged in a vertical direction, each slit being distanced at regular intervals from each other, and an exhaust duct having opened upper and front portions and a plurality of coupling hooks projected from both sides of the front portion to be inserted into the slits, the exhaust duct being coupled to the slits to surround the exhaust holes, thereby directing the exhausted air in an upward direction.

The guiding means prevents hot air heated by passing an electric component compartment and a cooking chamber from entering the cooling chamber through a plurality of intake holes formed on a protective cover joined to the inner case again. As a result, the performance of the driving motor installed in the cooling chamber is enhanced, and the breakdown of the motor coil due to hot air generated by the electric heater is prevented.

DETAILED DESCRIPTION OF THE PREFERRED EMBODIMENT

Figure 1:
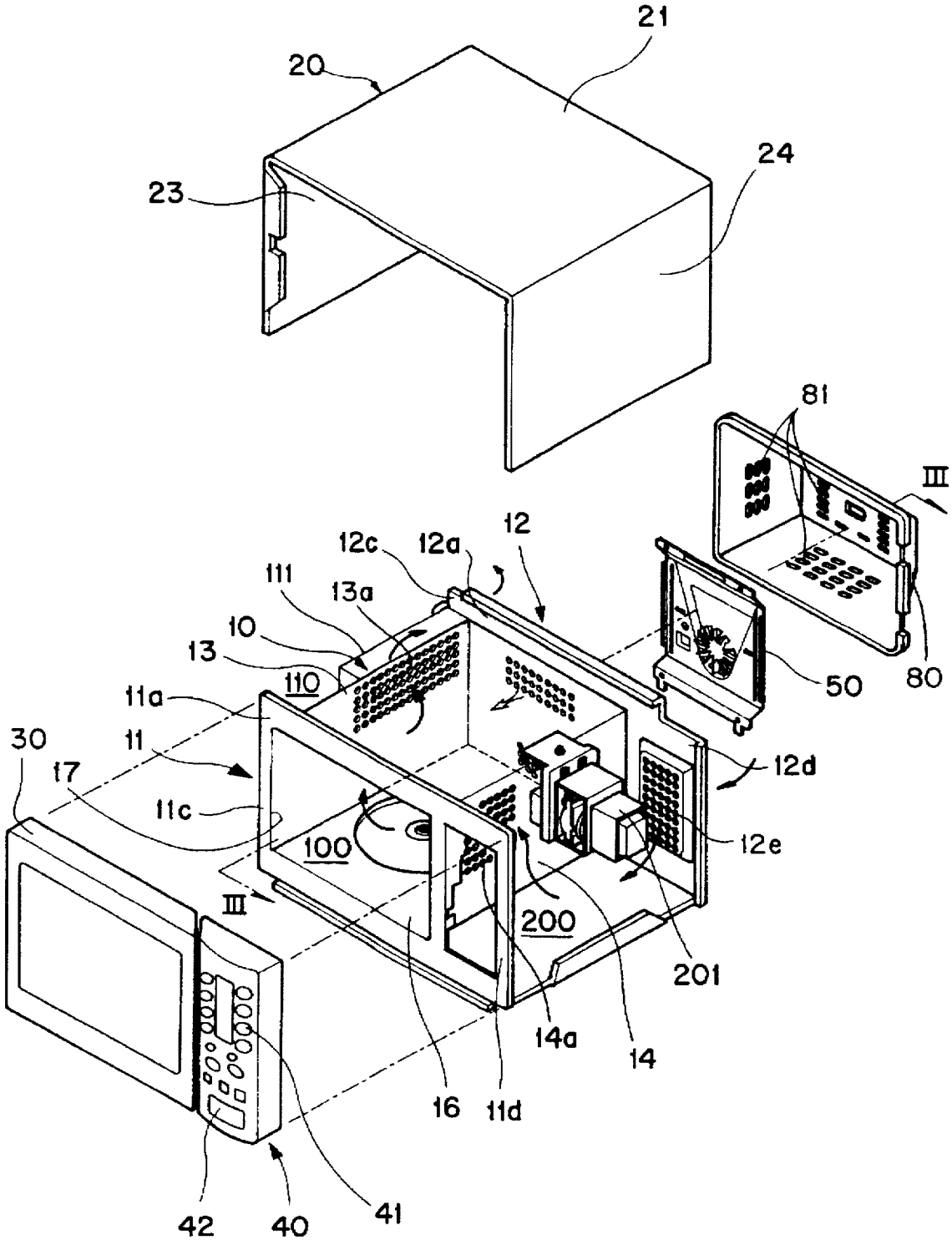
FIG. 1 is an exploded perspective view of a convection microwave oven according to the present invention.

As shown in FIG. 1, a convection microwave oven to which the present invention is applied includes a housing comprised of an inner case 10, an outer case 20 which forms one assembly together with the inner case 10, and various kinds of electric components mounted between the inner and outer cases 10 and 20. On the back side of the inner case 10, a duct 50 and a protective cover 80 are removably mounted.

The inner case 10 comprises a front plate 11, a rear plate 12, left and right side plates 13,14, and a bottom plate 16, which form a cooking chamber 100. On the front plate 11, an opening 17 which serves as the inlet of the cooking chamber 100 is formed.

The front plate 11 includes an upward extending plate 11*a* and, left and right extending plates 11*c* and 11*d*, each being extended, at a predetermined width, in the upper, left and right directions. The rear plate 12 facing the front plate 11 also includes an upward extending plate 12*a* and, left and right extending plates 12*c*,12*d*, each being extended, at a predetermined width, in the upper, left and right directions.

The outer case 20 includes a top plate 21, a left side plate 23, and a right side plate 24. Edges of each plate forming the outer case 20 are coupled to edges of the extending plates forming the front and rear plates 11 and 12 of the inner case 10 so as to form a main body of the microwave oven. In this case, lengths from the front to the rear of each plate forming the outer case 20 are equal to those of each corresponding plate of the inner case 10 and the outer case 20 is spaced from the inner case 10 by as much as the width of the extending plates of the inner case 10. The rear plate 12 of the inner case 10 also serves as a rear plate for the outer case 20.

On the front plate 11 of the inner case 10, a door 30 is mounted to open and close the cooking chamber 100, and on the right extending plate 11*d* of the front plate 11, a control panel 40 having a display 41 and buttons 42 is mounted. A space defined by the right side plates 14 and 24 of the inner and outer cases 10 and 20, and the right extending plates 11*d* and 12*d* of the front and rear plates 11 and 12 is used as an electric component compartment 200 in which electric components such as a magnetron 201 are mounted. A space defined by the left side plates 13,23 of the inner and outer cases 10,20, and the left extending plates 11*c* and 12*c* of the front plate 11 and the rear plate 12 is used as an exhaust passage 110.

To cool the electric component compartment 200 and remove humidity and odor of the cooking chamber 100, the right extending plate 12*d* of the rear plate 12 and the right side plate 14 of the inner case 10 have a plurality of intake holes 12*e* and first air vents 14*a*, respectively, and the left side plate 13 and the left extending plate 12*c* of the rear plate 12 have a plurality of second air vents 13*a* and vertical row of exhaust holes 12*f* (refer to FIG. 4), respectively. As a result, outside air coming in through the intake holes 12*e* passes via air vents 14*a*, 13*a*, and 12*f* through the electric component compartment 200, the cooking chamber 100, and the exhaust passage 110 and is then exhausted outside again.

Further, a guide 111 for guiding the air passing from the second air vents 13*a* to the exhaust holes 12*f* is arranged between the left side plate 13 and the rear plate 12.

Figure 2:
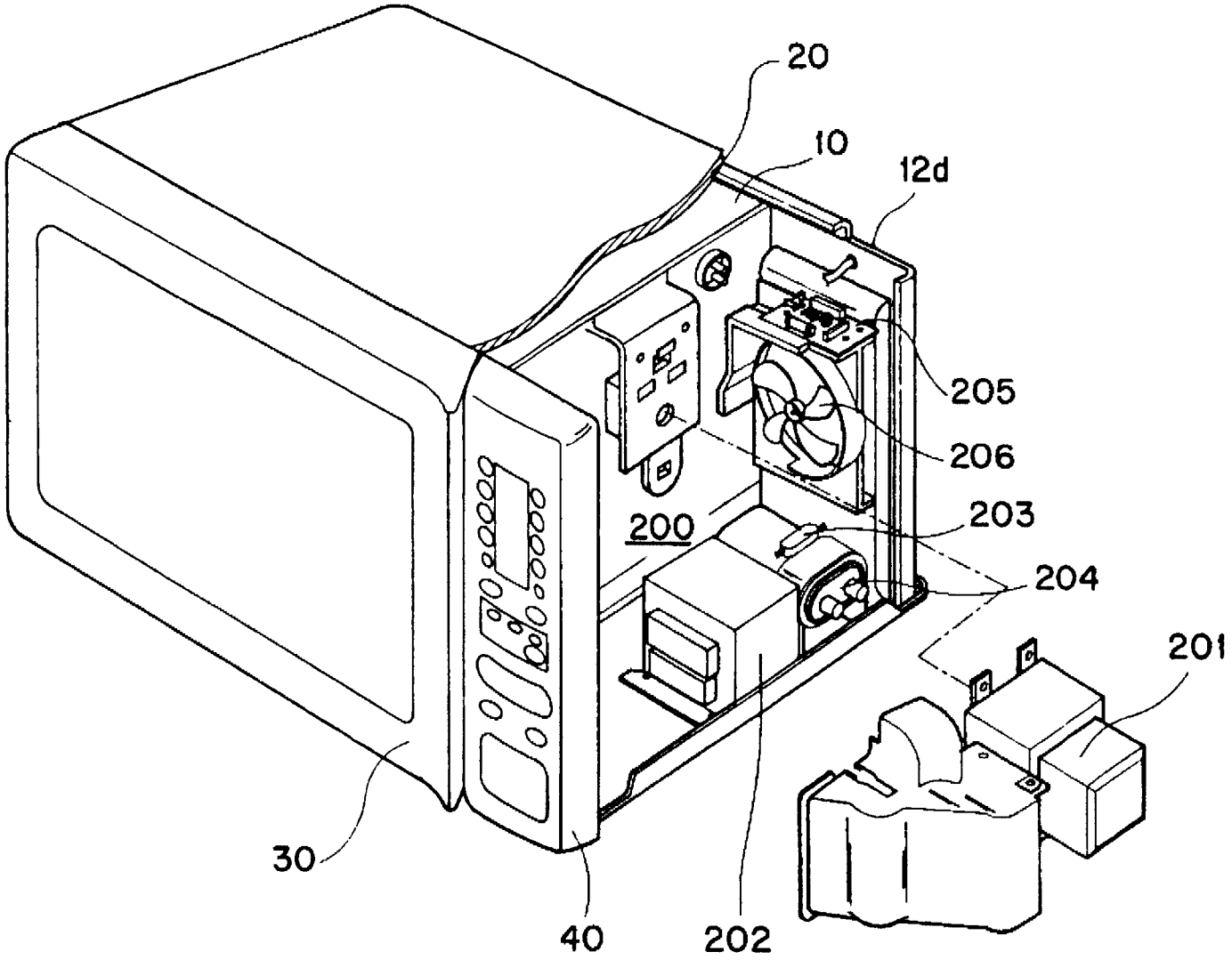
FIG. 2 is a perspective view, partly in section, showing an electric component compartment of the present invention.

FIG. 2 shows the structure of the electric component compartment 200. In the electric component compartment 200, a magnetron 201 for radiating high frequency into the cooking chamber 100 is installed. Around the magnetron 201, a high voltage transformer 202, a high voltage diode 203, a high voltage capacitor 204, and a printed circuit board 205 are installed. A cooling fan 206 for cooling electric components which become operation is also installed in the rear of the electric component compartment 200.

Figure 3:
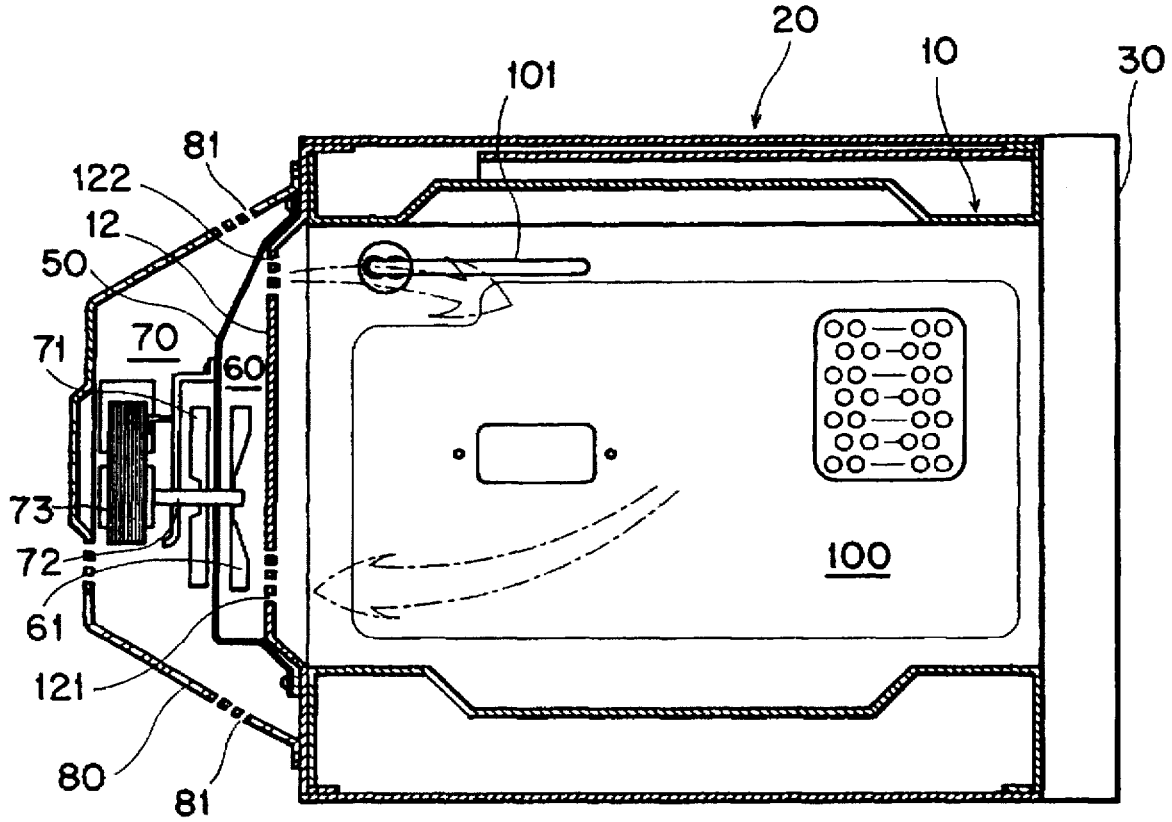
FIG. 3 is a cross-sectional view taken along a line III—III in FIG. 1.

As shown in FIG. 3, an electric heater 101 is installed inside of the cooking chamber 100. The electric heater 101 is pivotally mounted on the upper portion of the cooking chamber 100. A plurality of intake and exhaust holes 121 and 122 for guiding forced convection of hot air are formed in the rear plate 12 of the inner case 10, and a duct 50 is joined to an outside of the rear plate 12. Thus, a hot air blowing chamber 60 is formed between the rear plate 12 and duct 50, and the intake and exhaust holes 121 and 122 serve to communicate the cooking chamber 100 with the hot air blowing chamber 50. In the hot air blowing chamber 60, a blower fan 61 is installed. Externally of the duct 50, an electric motor 73 and a blower fan 71 for cooling the electric motor 73 are arranged. A rotating shaft 72 is coupled to the electric motor 73 to transfer the driving force. The rotating shaft 72 penetrates the cooling fan 71 and the blower 61 to hold them rotatably.

To protect the duct 50, the cooling fan 71, and the electric motor 73, a protective cover 80 having a large size enough to cover them is also mounted on the rear plate 12 of the inner case 10. Therefore, a cooling chamber 70 is formed between the duct 50 and the protective cover 80. This protective cover 80 has a plurality of air vents 81.

Figure 4:
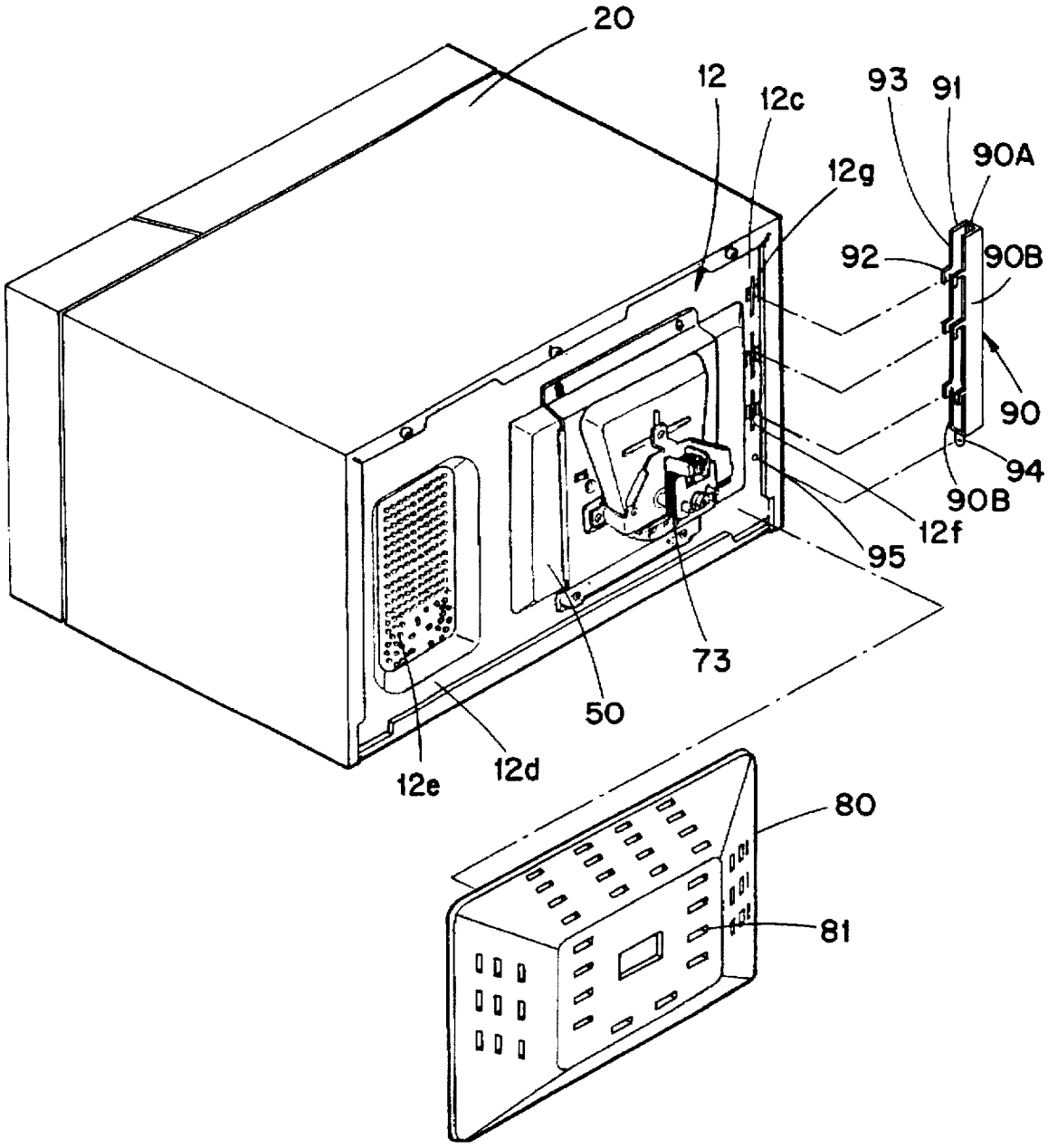
FIG. 4 is a rear perspective view of a convection microwave oven showing a feature of the present invention.
Figure 5:
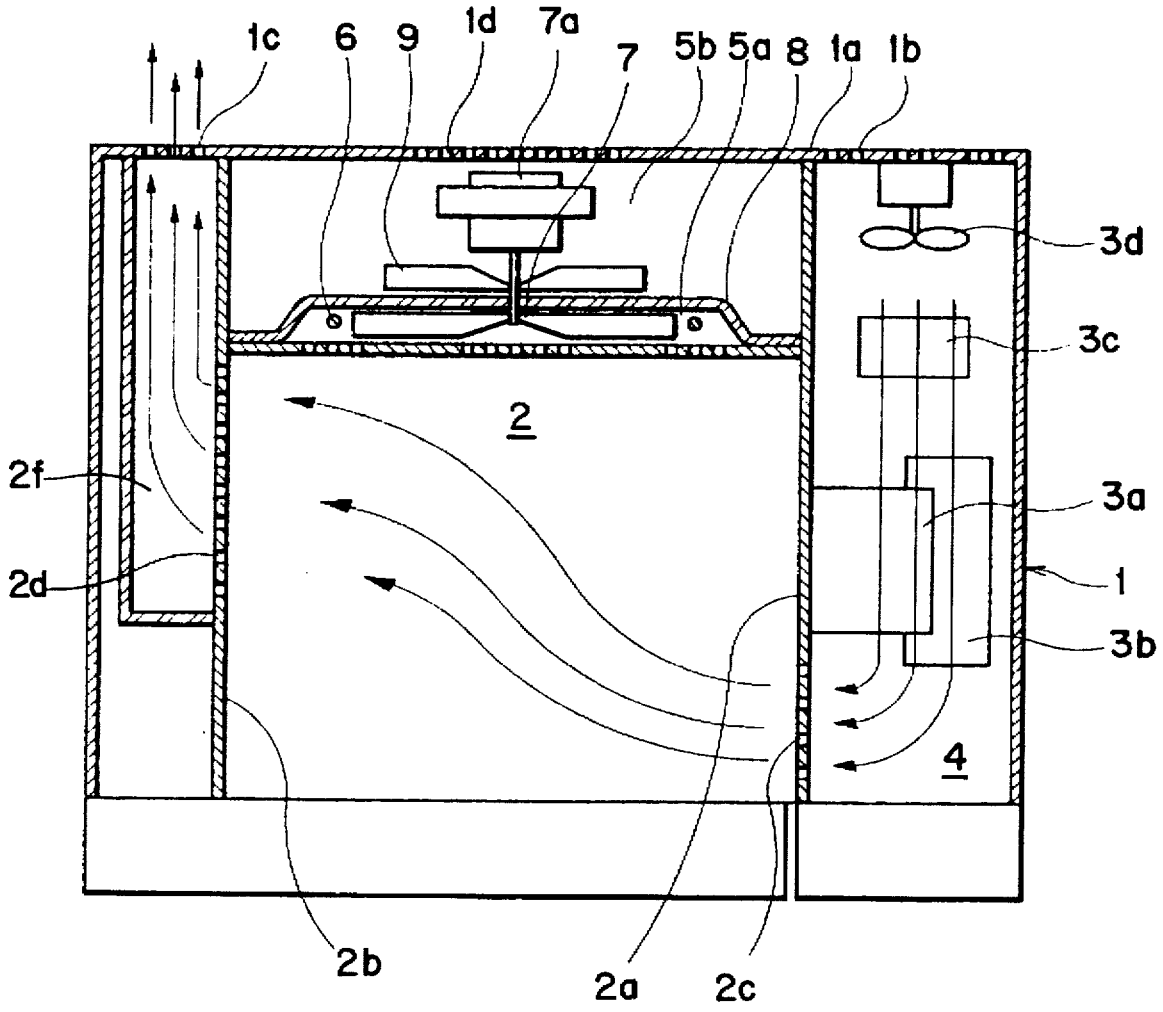
FIG. 5 (PRIOR ART)
FIG. 5 is a cross-sectional view of a prior art convection microwave oven.

FIG. 4 shows the structure of an exhaust duct 90 in accordance with a feature of the present invention. The exhaust duct 90 has a 'U' shaped section extended along the vertical direction. The duct 90 includes a duct rear wall 90A and a pair of duct side walls 90B projecting forwardly therefrom. The bottom of the exhaust duct 90 is closed and the front portion 93 and top portion 91 are opened. On a front vertical edge of each duct side wall 90B a plurality of coupling hooks 92 are projected at regular vertically spaced intervals. On the bottom of the exhaust duct 90, a hole 94 is formed. This exhaust duct 90 is mounted on the left extending plate 12*c* of the rear plate 12 to cover the exhaust holes 12*f*.

As mentioned above, the duct 50 is attached to the rear plate 12 to define the hot air blowing chamber 60 communicating with the cooking chamber 100 (refer to FIG. 3), and the protective cover 80 is also attached to the rear plate 12 to protect the electric motor 73 installed outside of the duct 50. The protective cover 80 has the air vents 81 for allowing the outside air to cool the electric motor 73.

Further, on the right extending plate 12*d* of the rear plate 12, the intake holes 12*e* venting the electric component compartment 200 are formed. In the left extending plate 12*c* of the rear plate 12, the exhaust holes 12*f* venting the exhaust passage 110 (refer to FIG. 1) are also formed. The exhaust holes 12*f* are arranged in the vertical direction with regular intervals from each other. On both sides of the exhaust holes 12*f*, a plurality of slits 12*g* corresponding to the hooks 92 of the exhaust duct 90 are formed. A hole 95 corresponding to the hole 94 of the exhaust duct 90 is formed under the exhaust holes 12*f*.

Therefore, the hooks 92 of the exhaust duct 90 are hooked into the slits 12*g* by and then a screw is screwed to the holes 94 and 95 to fasten the exhaust duct 90 to the rear plate 12 securely. In this state, since the left and right and downward directions of the exhaust holes 12*f* are closed by the exhaust duct 90, the exhaust holes 12*f* vent air only in an upward direction.

The operation of this invention will now be described. First, when the start button is depressed to cook food by the high frequency energy, power is supplied to the magnetron 201, so that the high frequency is radiated into the cooking chamber 100. Thus, the food in the cooking chamber 100 is cooked. Simultaneously, the cooling fan 206 located in the electric component compartment 200 is operated to draw the outside air inside through the intake holes 12*e*. After the air enters and the electric components are cooled in the electric component compartment 200, it becomes hot and then goes into the cooking chamber 100 through the first air vents 14*a*. Passing the cooking chamber 100 the hot air removes humidity and odor generated by the high frequency heat to the exhaust passage 110 through the second air vents 13*a*. Therefore, the temperature of the air passing through the second air vents 13*a* becomes higher. That air enters the exhaust passage 110 along the guide 111, and passes through the exhaust holes 12*f*. Finally, the air is exhausted in the upward direction of the microwave oven while guided by the exhaust duct 90.

Food can be cooked by the forced convection of hot air and/or by the high frequency energy. Cooking by convection of hot forced air will now be described.

First, when electric power is supplied to the electric heater 101 to heat the heater 101 and the blower fan 61, air in the cooking chamber 100 enters the hot air blowing chamber 60 through the below intake holes 121 and is guided upward along the duct 50. The air is exhausted from the hot air blowing chamber 60 to the cooking chamber 100 through the exhaust holes 122, with heat generated by the electric heater 101. The heat is distributed in every direction to cook the food.

In addition, the cooling fan 71 is operated together with the electric heater 101 and the blower fan 61. If the cooling fan 71 rotates, the outside air enters the cooling chamber 70 through the air vents 81 formed in the protective cover 80 to cool the motor 73, and then it is exhausted outside. Here, a portion of hot air which is exhausted from the hot air blowing chamber 60 to the cooking chamber 100 is discharged into the exhaust passage 110 with the air drawing into the cooking chamber 100 by the cooling fan 206 of the electric component compartment 200. Thus, the discharged air becomes hotter compared with the air temperature at the cooking by the high frequency energy. The hot air passing the exhaust holes 12*f* from the exhaust passage 110 is directed in an upward direction by the guidance of the exhaust duct 90.

As mentioned above, in the convection microwave oven according to the present invention, the hot air passing the cooking chamber is guided upward along the exhaust duct, so that the hot air does not enter the protective cover again, which surrounds the motor, through the intake and exhaust holes.

Therefore, only the ambient air of a low temperature is drawn into the protective cover, thereby cooling the electric motor more effectively. In addition, since the electric motor does not contact the hot air, the breakdown of the motor coil by heating is prevented.

In conclusion, according to the present invention, the efficiency and life of the electric motor, which provides the driving force for circulating the hot air, is increased.

What is claimed is:

1. A convection microwave oven comprising:

a housing including first and second housing side walls and a housing rear wall arranged to form a cooking chamber, the housing forming an electric component compartment arranged along an outer surface of the first housing side wall;

a magnetron arranged in the electric component compartment for generating microwaves to be supplied to the cooking chamber;

an air exhaust passage arranged along an outer surface of the second housing side wall to exhaust air through a vertical row of exhaust holes disposed in the housing rear wall, the housing rear wall including slits formed on opposite sides of the vertical row of exhaust holes;

an electric heater disposed in the cooking chamber;

a duct spaced behind the housing rear wall to form therewith a hot air chamber;

a first fan disposed in the hot air chamber for circulating hot air to the cooking chamber;

a protective cover spaced behind the duct to form therewith a cooling chamber;

a motor and second fan disposed in the cooling chamber for circulating cooling air through vents formed in the protective cover; and a vertical duct of generally U-shaped cross section including a duct rear wall and a pair of duct side walls protecting forwardly from the duct rear wall, each duct side wall including a vertical edge from which vertically spaced hooks project, the hooks removably inserted in respective ones of the slits, whereby the vertical duct encompasses the exhaust holes, the vertical duct being closed at a bottom end thereof and open at an upper end thereof for directing exhaust air from the exhaust holes upwardly through the open upper end.

2. The oven according to claim 1 wherein the air exhaust passage includes a guide wall spaced from the cooking chamber for guiding exhaust air toward the exhaust holes.

* * * * *